US012655721B1

(12) United States Patent
Ejim

(10) Patent No.: US 12,655,721 B1
(45) Date of Patent: Jun. 16, 2026

(54) CHEMICAL INJECTION SYSTEMS AND RELATED METHODS

(71) Applicant: Saudi Arabian Oil Company, Dhahran (SA)

(72) Inventor: Chidirim Enoch Ejim, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/170,555

(22) Filed: Apr. 4, 2025

(51) Int. Cl.
*E21B 37/06* (2006.01)
*E21B 43/12* (2006.01)

(52) U.S. Cl.
CPC ..... *E21B 37/06* (2013.01); *E21B 43/128* (2013.01)

(58) Field of Classification Search
CPC ..... E21B 37/06; E21B 41/02; E21B 43/128
See application file for complete search history.

(56) References Cited

U.S. PATENT DOCUMENTS 4,580,634 A * 4/1986 Cruise ..... E21B 43/00 166/371
4,582,131 A * 4/1986 Plummer ..... E21B 41/02 166/310
10,538,992 B2 1/2020 Woodford
2015/0369229 A1* 12/2015 Xiao ..... F04F 5/10 417/54
2016/0290111 A1 10/2016 Patel

* cited by examiner

*Primary Examiner* — Giovanna Wright
(74) *Attorney, Agent, or Firm* — Fish & Richardson P.C.

(57) ABSTRACT

A chemical injection system includes an electric submersible pump (ESP) and a fluid chamber. The ESP lifts a production fluid through a production string disposed within a wellbore. The fluid chamber is coupled with the ESP and houses a treatment fluid. The fluid chamber defines, together with a wall of the wellbore, an annulus. The ESP flows at least a portion of the production fluid into the fluid chamber to push the treatment fluid out of the fluid chamber into the annulus, allowing the treatment fluid to flow from the annulus into the ESP to treat the ESP.

12 Claims, 4 Drawing Sheets

CHEMICAL INJECTION SYSTEMS AND RELATED METHODS

TECHNICAL FIELD

This disclosure relates to well production equipment, and more particularly to downhole chemical injection systems and related methods of treating an electronic submersible pump (ESP).

BACKGROUND

In hydrocarbon production, an electric submersible pump (ESP) is used to artificially lift oil or gas from a well when natural reservoir pressure is insufficient. ESPs can malfunction or lose efficiency due to clogging, corrosion, or formation of obstructions such as wax, asphaltenes, and scale. These issues can reduce pump performance, increase energy consumption, and eventually lead to costly shutdowns or replacements. For example, some of the challenges associated with electrical submersible pumps (ESP) production is the cumulative buildup of obstructions such as scale, wax, or asphaltene on the components of the ESP. Over prolonged productions periods, these substances can accumulate to block the flow paths of the pumping section of the ESP, causing reduced production of fluid to surface, and leading to deferred production. Additional consequences include motor overheating due to lack of cooling, which can lead to failure of the ESP system. When the ESP fails, a workover rig is often required to retrieve the equipment, which can lead to significant operational expenditures incurred by the operator. In some implementations, surface chemical injection systems may be used.

SUMMARY

Implementations of the present disclosure include a method that includes flowing, by a pump of an electric submersible pump (ESP) and through a production tubing fluidly coupled to the ESP, a production fluid from a downhole location of a wellbore to a terranean surface at an uphole end of the wellbore. The method also includes flowing a portion of the production fluid from the ESP into a fluid chamber coupled to the ESP. The fluid chamber houses a treatment fluid and defines, with a wall of the wellbore, an annulus. The method also includes pushing, with the portion of the production fluid, the treatment fluid out of the fluid chamber into the annulus. The method also includes flowing the treatment fluid from the annulus into the ESP to treat the ESP.

In some implementations, the pump includes a production fluid inlet and a production fluid outlet and the fluid chamber includes a first fluid inlet, a second fluid inlet, and a treatment fluid outlet. A fluid conduit extends from the production fluid outlet of the pump to the first fluid inlet of the fluid chamber. The second fluid inlet is arranged to receive the treatment fluid to be stored in the fluid chamber, and the treatment fluid outlet is arranged to direct the treatment fluid out of the fluid chamber. Flowing the portion of the production fluid into the fluid chamber includes flowing the portion of the production fluid from the production fluid outlet of the pump to the first fluid inlet through the fluid conduit.

In some implementations, the first fluid inlet resides at a first sub-chamber of the fluid chamber. The first sub-chamber is separated from a second sub-chamber of the fluid chamber by a plunger disposed between the first sub-chamber and the second sub-chamber. The second sub-chamber contains the treatment fluid, and flowing the portion of the production fluid into the fluid chamber includes flowing the portion of the production fluid into the first sub-chamber to push the plunger, thereby pushing the treatment fluid out of the fluid chamber through the treatment fluid outlet. In some implementations, the fluid chamber includes a tension spring configured to retract the plunger in an uphole direction. The method further includes reducing a flow of the portion of the production fluid into the fluid chamber, thereby allowing the plunger to be retracted by the tension spring.

In some implementations, treating the ESP includes minimizing a formation of at least one of scale, wax, or asphaltene on the ESP.

Implementations of the present disclosure also include a wellbore assembly that includes a production string, an electric submersible pump (ESP), a fluid chamber, and a fluid conduit. The production string is disposed within a wellbore. The ESP is configured to lift production fluid through the production string. The ESP includes a pump fluidly coupled with the production string, and a motor coupled with and configured to drive the pump. The fluid chamber is coupled with the ESP and configured to house a treatment fluid. The fluid chamber defines, together with a wall of the wellbore and with the fluid chamber being coupled with the ESP, an annulus. The fluid conduit fluidly connects the pump with the fluid chamber to allow the pump to flow a portion of the production fluid into the fluid chamber to push, with the portion of the production fluid, the treatment fluid out of the fluid chamber to the annulus, thereby allowing the treatment fluid to flow from the annulus into the ESP to treat the ESP.

In some implementations, the pump includes a production fluid inlet and a production fluid outlet and the fluid chamber includes a first fluid inlet, a second fluid inlet, and a treatment fluid outlet. The fluid conduit extends from the production fluid outlet of the pump to the first fluid inlet of the fluid chamber. The second fluid inlet is arranged to receive the treatment fluid to be stored in the fluid chamber, and the treatment fluid outlet arranged to direct the treatment fluid out of the fluid chamber.

In some implementations, the first fluid inlet resides at a first sub-chamber of the fluid chamber. The first sub-chamber is separated from a second sub-chamber of the fluid chamber by a plunger disposed between the first sub-chamber and the second sub-chamber. The second sub-chamber contains the treatment fluid and the first sub-chamber is configured to receive the portion of the production fluid that pushes the plunger to push the treatment fluid out of the fluid chamber.

Implementations of the present disclosure also include a chemical injection system that includes an electric submersible pump (ESP) and a fluid chamber. The ESP lifts a production fluid through a production string disposed within a wellbore. The fluid chamber is coupled with the ESP and configured to house a treatment fluid. The fluid chamber defines, together with a wall of the wellbore, an annulus. The ESP is configured to flow at least a portion of the production fluid into the fluid chamber to push the treatment fluid out of the fluid chamber into the annulus, thereby allowing the treatment fluid to flow from the annulus into the ESP to treat the ESP.

In some implementations, the fluid chamber is disposed downhole of the ESP. In some implementations, the chemical injection system further including a fluid conduit extending between and fluidly coupling the ESP and the fluid chamber, the ESP including a pump and a motor configured to drive the pump. The fluid conduit directs fluid from the pump to the fluid chamber. In some implementations, the motor is disposed between the pump and the fluid chamber. In some implementations, the motor is disposed uphole of the pump and the fluid chamber is coupled directly with the pump. The fluid chamber includes an annular fluid chamber defining an annular volume configured to house the treatment fluid. The annular fluid chamber defines an inner bore fluidly decoupled from the annular volume and arranged to direct the production fluid uphole from the wellbore into the pump.

In some implementations, the pump includes a production fluid inlet and a production fluid outlet and the fluid chamber includes a first fluid inlet, a second fluid inlet, and a treatment fluid outlet. The fluid conduit extends from the production fluid outlet of the pump to the first fluid inlet of the fluid chamber. The second fluid inlet is arranged to receive the treatment fluid to be stored in the fluid chamber, and the treatment fluid outlet is arranged to direct the treatment fluid out of the fluid chamber.

In some implementations, the production fluid outlet includes a discharge head of the pump and the first fluid inlet resides at a first sub-chamber of the fluid chamber. The first sub-chamber is separated from a second sub-chamber of the fluid chamber by a plunger disposed between the first sub-chamber and the second sub-chamber. The second sub-chamber contains the treatment fluid and the first sub-chamber receives the at least a portion of the production fluid that pushes the plunger to push the treatment fluid out of the fluid chamber. In some implementations, the fluid chamber includes a tension spring configured to retract the plunger in an uphole direction.

In some implementations, the fluid chamber defines an inner volume arranged to contain the treatment fluid. The treatment fluid includes a chemical configured to treat the ESP to prevent formation of at least one of scale, wax, or asphaltene on the ESP.

In some implementations, the fluid chamber includes a sealing elastomer disposed at an external surface of the fluid chamber, the sealing elastomer arranged to interface with a packer to provide, together with the packer and with the packer set on the wellbore, a fluid seal.

In some implementations, the fluid chamber includes a valve coupled with a fluid outlet of the fluid chamber, the valve configured to allow the treatment fluid to exit the fluid chamber and prevent fluid from entering the fluid chamber through the fluid outlet.

In some implementations, the valve includes at least one of a check valve or a one-way valve. The valve is arranged to open under a first fluid pressure inside the fluid chamber and close under a second fluid pressure inside the fluid chamber. The first fluid pressure is greater than the second fluid pressure.

Particular implementations of the subject matter described in this specification can be implemented so as to realize one or more of the following advantages. For example, compared to surface chemical injection systems, the downhole injection system of the present disclosure can reduce the surface footprint of the system and can enable faster chemical treatments using less equipment. Moreover, the method of downhole treatment can be performed automatically. Moreover, the chemical chamber can be retrofitted into existing equipment or be installed with new equipment. These advantages can help save time and resources.

DETAILED DESCRIPTION OF THE DISCLOSURE

The present disclosure describes methods and equipment used to preform downhole chemical injection using the electric submersible pump (ESP). The equipment includes a chemical injection chamber connected to the ESP. To inject the chemical, some of the available pressure developed by the ESP is routed to the chemical injection chamber to release the liquid chemical inside the chamber. Such chemicals can help mitigate downhole scale, asphaltene, wax, or similar substances that can lead to blockage of the flow paths within the pumping section of the ESP.

To control the injection of the chemical, the speed of the pump can be increased to cause some of the high-pressure fluid from the pump discharge head to be routed through the hydraulic line into the chemical chamber. This causes the liquid chemical to be discharged, under fluid pressure from the ESP, into the well to treat the ESP. When the pump is turned on, some of the high-pressure fluid from the pump discharge head is routed through the hydraulic line into the chemical chamber, which causes the liquid chemical to be discharged from the chemical chamber. The discharged chemical is carried upward by the well fluid and flows past the motor, protector, and into the pump. The reaction of the chemical with the wetted surfaces of the ESP prevents the formation of obstructions that would have blocked the pump flow path after prolonged production. Furthermore, the outer surfaces of the ESP can be protected from such obstructions because the wellbore fluid and chemical mixture are in contact with those surfaces.

In some aspects, the chemical injection chamber can be used in conventional tubing-deployed ESP architectures. In some aspects, the chemical injection chamber can be used with a rigless-deployed system, such as a Cable Deployed ESP (CDESP) system. The CDESP system can be installed through the production tubing. However, such architecture can also be used if installing the system in a casing.

Figure 1:
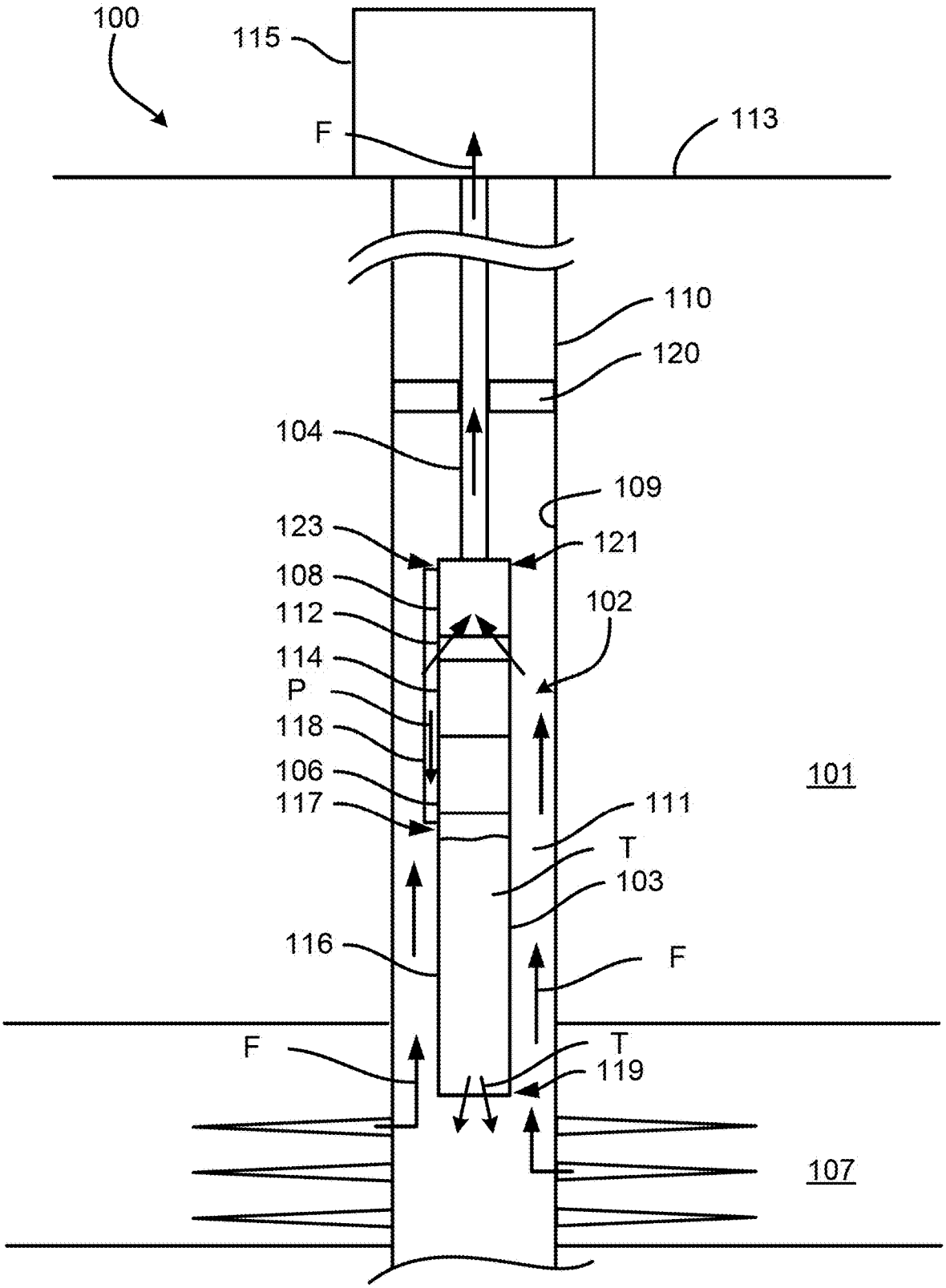
FIG. 1 shows a front schematic view, partially cross-sectional, of an example wellbore assembly according to implementations of the present disclosure.

FIG. 1 shows a wellbore assembly 100 (e.g., a production assembly) disposed within a wellbore 110. The wellbore assembly 100 includes a wellbore string 104 (e.g., production tubing 104) attached to an electric submersible pump (ESP) 102. The wellbore assembly 100 also includes a packer 120 (e.g., a production packer) that is attached to the wellbore string 104 or the ESP 102 to isolate a section of the wellbore 110 and/or secure the downhole equipment to the wellbore 110. The ESP 102 includes a motor 106, a pump 108, a pump intake 112 (e.g., a production fluid inlet 112 of the pump 108), and a seal or protector 114. The wellbore assembly 100 also includes a treatment fluid chamber 103 (e.g., a chemical injection chamber or tank) that stores a fluid or substance "T" for treating the ESP 102. The ESP 102 and the fluid chamber 103 together form, for example, a downhole chemical injection system (DCIS).

The wellbore 110 extends through a subterranean zone 101 that includes a geologic formation 107. For example, the wellbore 110 extends down from a surface 113 (e.g., a terranean surface) of the wellbore 110 and is formed in the geologic formation 107. In some aspects, the geologic formation 107 has one or more hydrocarbon reservoirs from which production fluid "F" (e.g., wellbore fluid such as hydrocarbons) can be extracted.

The wellbore string 104 is connected with and extends from surface equipment 115 (e.g., a wellhead and/or Christmas tree) that receives the production fluid "F" from the wellbore string 104. The wellbore string 104 forms, with a wall 109 of the wellbore 110, an annulus 111. The annulus 111 can extend, for example, from the packer 120 (e.g., a production packer) to the bottom of the well or another packer. In some aspects, the ESP 102 is connected using a conventional tubing-deployed ESP architecture.

The pump 108 is coupled with the wellbore string 104. The pump 108 is driven by the motor 106 to receive the production fluid "F" from the intake 112 and flow the production fluid "F" up the wellbore 110 through the wellbore string 104. The production fluid "F" flows from the formation 107 and can include water, hydrocarbons, and other formation fluids.

The fluid chamber 103 houses the treatment fluid "T." The annulus 111 also extends and is defined between the fluid chamber 103 and the wall 109 of the wellbore 110. The production fluid "F" flows from the formation 107, through the annulus 111, and into the ESP 102 at the fluid inlet 112. As further described in detail below with respect to FIGS. 2 and 3, the treatment fluid "T" is selectively flowed out of the chamber 103 into the wellbore and annulus 111 so that the treatment fluid "T" flows, with the production fluid "F," around and into the ESP 102 to treat the ESP 102.

The wellbore assembly 100 also includes a fluid conduit 118 that fluidly connects the pump 108 with the fluid chamber 103 to allow the pump 108 to flow, during the operation of the ESP 102, a second fluid "P" (e.g., a portion of the pressurized production fluid "F") into the fluid chamber 103 to push, with the second fluid "P," the treatment fluid "T" out of the fluid chamber 103 to the annulus 111, allowing the treatment fluid "T" to flow from the annulus 111 into the ESP 102 to treat the ESP 102 (e.g., wetted, internal and external surfaces of the ESP 102).

The fluid chamber 103 has a fluid inlet 117 and a fluid outlet 119. As discussed above, the pump 108 includes the fluid intake 112. The pump 108 also includes a fluid outlet 123. The fluid conduit 118 extends from the fluid outlet 123 of the pump 108 to the fluid inlet 117 of the fluid chamber 103. The pressurized fluid from the pump 108 flows into the fluid chamber 103 through the conduit 118 to push the treatment fluid "T" out of the chamber 103 through the fluid outlet 119 of the fluid chamber 103.

In some aspects, the fluid outlet 123 is at (or is part of) a pump discharge head 121 of the pump 108. The pump discharge head 121 is connected to the production string 104 to flow the production fluid up to the surface of the wellbore. Positioning the fluid outlet 123 at the pump discharge head 121 can be advantageous because of the availability of pressure taps at the pump discharge head 121. However, the fluid outlet 123 can reside at a different location of the pump 108 as long as the pump 108 has the required pressure to operate the fluid chamber 103.

Figure 2:
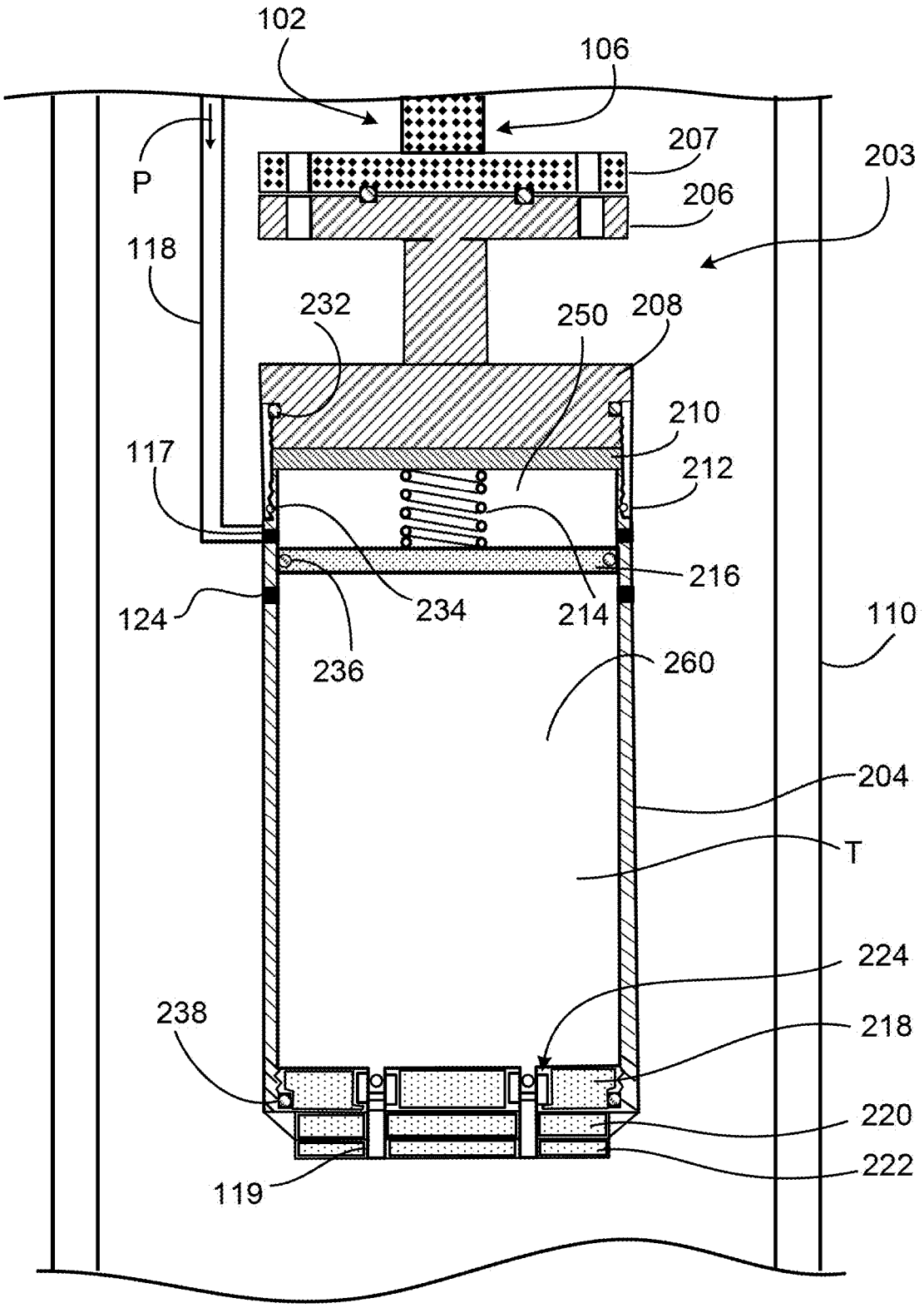
FIG. 2 is a front schematic view, cross-sectional, of the fluid chamber according to a first implementation of the present disclosure.

FIG. 2 is a schematic, cross-sectional view of a fluid chamber 203 according to the present disclosure. For example, the fluid chamber 203 may be an embodiment of the fluid chamber 103. The fluid chamber 203 includes, for example, a housing 204, a flange 206, a top cap 208, a first plate 210, a connection sleeve 212, a piston 216 (or plunger), a spring 214, a seal cap 218, a second plate 220, a bottom cap 222, and one or more valves 224. The spring 214 is connected to the first plate 210 and to the piston 216. The top cap 208, seal cap 218, second plate 220, and bottom cap 222 form the top and bottom seals of the fluid chamber 203 to prevent fluid from leaking through the fluid chamber 203. To further prevent such leakage, the fluid chamber 203 has multiple scaling rings 232, 234, 236, 238. The sealing rings prevent fluid from leaking through the connections between the housing 204 and the various members of the fluid chamber 203 threadedly connected to the housing 204. In some aspects, the seals can be dynamic seals, and such seals prevent the mixing of well fluid with the liquid chemical in the chamber.

As shown, the fluid chamber 203 can be divided by the piston 216 into a first sub-chamber 250 and a second sub-chamber 260. The second sub-chamber defines a volume that contains the treatment fluid "T" before the treatment fluid is flowed out of the fluid chamber 203. The first sub-chamber 250 defines a volume that receives the pressurized fluid "P" from the pump. In some aspects, the first sub-chamber 250 is sized to match the intake area of the pump fluid supply of the ESP 102. The housing 204 receives, through its fluid inlet 117 and from the fluid conduit 118 that is connected to the pump of the ESP, pressurized fluid "P" from the ESP. As the pressurized fluid "P" fills the volume of the first chamber 250, the pressurized fluid "P" pushes the piston 216 downhole (e.g., in a downhole direction) to push the treatment fluid "T" out of the second sub-chamber 260.

The fluid inlet 117 of the fluid chamber 203 resides at the first sub-chamber 250 and the fluid outlet 119 (e.g., one or more fluid outlets 119) of the fluid chamber 203 resides at the second sub-chamber 260. The fluid chamber 203 also includes a second fluid inlet 124 that receives the treatment fluid "T" to be stored in the fluid chamber 203. For example, before lowering the fluid chamber 203 within the wellbore, the fluid chamber 203 is filled with the treatment fluid "T" at the surface of the wellbore.

The treatment fluid "T" can be, for example, a liquid chemical such as a scale inhibitor like phosphonates or polyacrylates, or other types of inhibitors. The reaction of the chemical with the wetted surfaces (e.g., internal wetted surfaces) of the ESP 102 can prevent any obstructions (e.g., scale, wax, asphaltene, etc.) formation that would otherwise block the pump flow path after prolonged production. Moreover, with such treatments, other outer surfaces of the ESP 102 that come into contact with the chemical can be protected from scale, wax, asphaltene, and other obstruction formation.

The fluid chamber 203 can be sized to contain a liquid chemical volume sufficient to last until the next pump maintenance schedule. The sizing can be based on the required discharge rate for that specific chemical. In some aspects, the chemical is discharged at a low discharge rate to ensure the total liquid volume in the chamber is sufficient to last until the next scheduled pump maintenance. In some aspects, the fluid chamber 203 is not a single unit, but may be a modular system, where many chambers are connected together to attain the required chemical volume for the operation.

In some aspects, the fluid chamber 203 resides downhole of the ESP 102 and is connected (e.g., directly connected) with the motor 106 of the ESP 102 or the lowermost component of the ESP 102. For example, the flange 206 of the fluid chamber 203 is connected to a flange 207 of the motor 106. Because the motor 106 is disposed between the pump of the ESP 102 and the fluid chamber 203, the fluid conduit 118 extends from the fluid chamber 203, past the motor 106, to the pump of the ESP 102.

As the pressurized fluid "P" pushes the piston 216 to push the treatment fluid "T" out of the second sub-chamber 260, the treatment fluid "T" exits through the one or more valves 224. The fluid chamber 203 can have, for example, two valves 224 disposed along respective fluid outlets 119. The valves 224 allow the treatment fluid "T" to exit the fluid chamber 203 and prevent fluid (e.g., production fluid) from entering the fluid chamber 203 through the fluid outlet 119.

In some aspects, the valves 224 are check valves, one-way valves, or a similar valves that allows fluid to flow out of the chamber, but not into the chamber. The valves 224 open under a first fluid pressure inside the fluid chamber 203 and close under a second fluid pressure inside the fluid chamber 203, where the first fluid pressure is greater than the second fluid pressure. For example, when the cracking (or opening) pressure of the valves 224 is exceeded, the valves 224 open and treatment fluid "T" is injected into the well fluid below the chamber 203. When the pressure of the treatment fluid "T" reduces below the cracking pressure of the valves 224, the valves 224 close and prevent any liquid from leaving the fluid chamber 203. The pressure of the treatment fluid "T" is controlled by the flow of pressurized fluid "P" into the fluid chamber 203.

The spring 214 is a tension spring that retracts the piston 216 absent sufficient fluid pressure in the first sub-chamber 250 to push the piston 216 downhole, toward the outlet 119 of the fluid chamber 203. Thus, when the ESP 102 does not provide sufficient fluid pressure, the spring 214 pulls the piston 216 upwards (e.g., in an uphole direction) to restore the piston 216 to its original position, which cause the pressure of the liquid chemical "T" to decrease. In some aspects, the fluid chamber does not include a spring such that the piston is not retracted by a spring to its original position.

In some aspects, the flow of fluid from the ESP 102 to the fluid chamber 203 is controlled by controlling the speed of the pump of the ESP 102. For example, increasing the pump rotational speed via a variable speed drive (VSD) increases the pump discharge pressure and therefore the pressure of the pressurized fluid "P" to a sufficient pressure to push the piston downhole and open the valves 224.

For example, if the normal rotational speed of the pump is 3500 RPM, at such speed, the pressurized fluid "P" enters the first sub-chamber 250 via the fluid line 118 without producing sufficient pressure to open the check valves 224. At least some of the opening pressure of the check valves 224, the stiffness of the tension spring 214, the weight and dimensions of the piston 216, the diameter of the fluid line 118, and the viscosity of the treatment fluid "T" are selected or designed so that the check valves 224 do not open under normal operating speed of the pump, and open above a certain fluid pressure of the treatment fluid "T."

To open the valves 224, the rotational speed of the ESP 102 is increased by adjusting the variable speed drive (e.g., adjusting the speed at the surface of the well). For a given pump size, pump boost pressure can vary as the square of the RPM. Thus, the increase in RPM results in a corresponding increase in the well fluid pressure above the piston 216. Once such pressure exceeds the cracking pressure of the valves 224, the valves 224 open and the treatment fluid is injected into the wellbore.

To stop liquid chemical injection, the VSD of the pump is adjusted to reduce the pump rotational speed back to the normal speed (e.g., 3500 RPM), which also decreases the pump discharge pressure. As the speed is reduced, the higher-pressure fluid in the first sub-chamber 250 above the piston 216 flows back through the fluid line 118 towards the pump discharge as the spring retracts the piston 216 upwards to force the well fluid out of the chamber 203. The pressure communication between the fluid above the piston 216 and at the pump discharge occurs fast to ensure pressure equalization. This ensures that the fluid pressure above the piston 216 is now at its previous magnitude before the RPM increase. Since the piston 216 no longer contacts the liquid chemical, the required force to keep the check valves 224 open is significantly reduced, causing the check valves 224 to close and stop liquid chemical release.

In some aspects, the pump can be controlled automatically based on, for example, (i) predetermined time intervals between chemical treatments, (ii) sensor data at the ESP (or elsewhere in the well) that indicates the formation of obstructions, or (iii) changes in operational parameters such as production rate, that can indicate the formation of obstructions. In some aspects, a monitoring sub/tool is installed at the motor of the ESP to measure parameters such as pump intake and discharge pressures, motor oil and winding temperature, and motor vibration. The measured downhole data is communicated to the surface via a power cable of the ESP, and such data can be used to determine whether there is a need for chemical treatment and thus a need to increase the speed of the pump to activate the fluid chamber.

Figure 3:
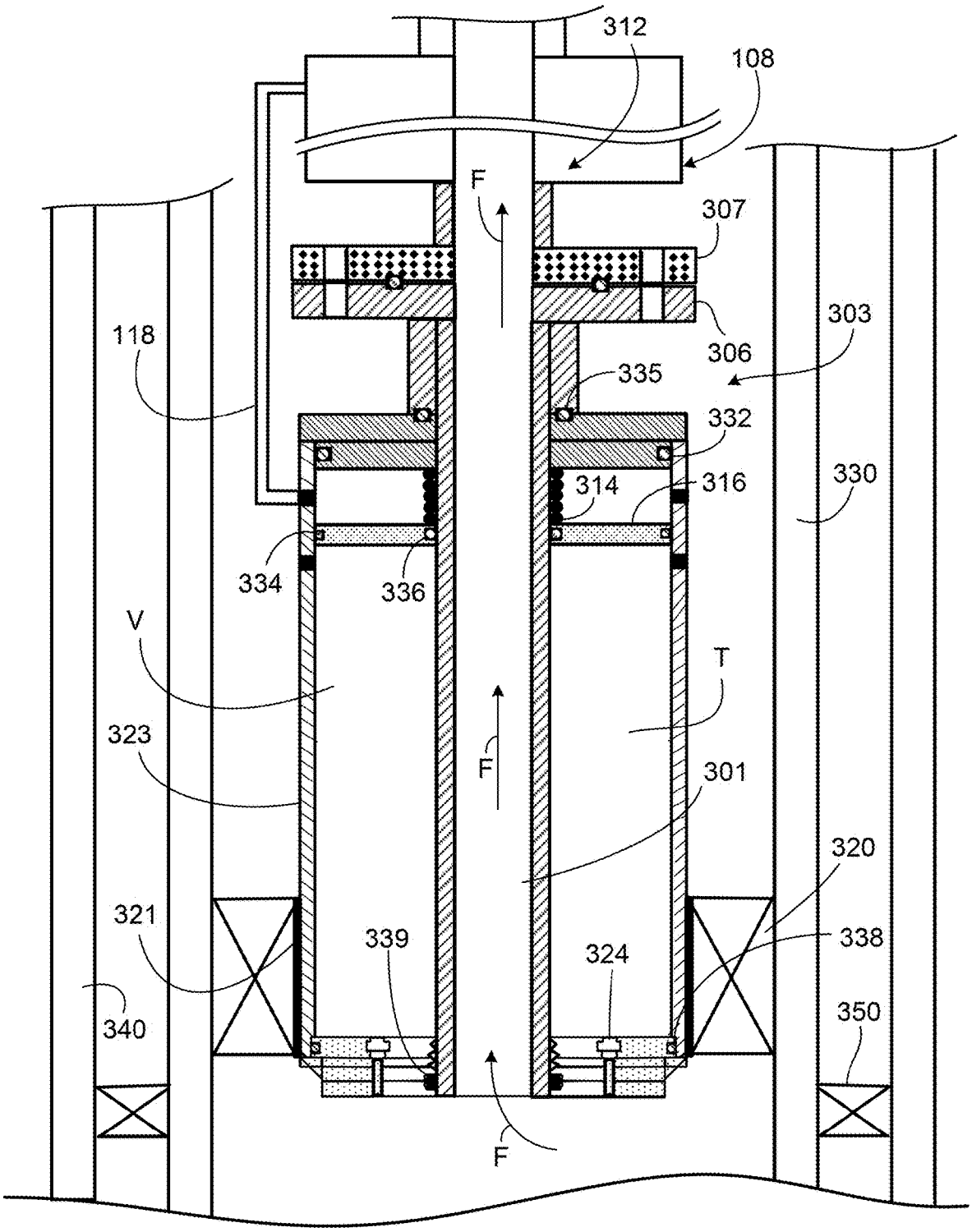
FIG. 3 is a front schematic view, partially cross-sectional, of the fluid chamber according to a second implementation of the present disclosure.

FIG. 3 is a front schematic view, partially cross-sectional, of a fluid chamber 303 according to another implementation of the present disclosure. In this implementation, the fluid chamber 303 can be used with a rigless deployed system, such as a Cable Deployed ESP system. The fluid chamber 303 can be installed through the production tubing 330. However, such architecture can also be used if installing the fluid chamber 303 and ESP in a casing 340. The fluid chamber 303 is similar to the fluid chamber 203 of FIG. 2, with the main exceptions being that, because the fluid chamber 303 is attached to the pump 108 of the ESP (instead of the motor of the ESP), the fluid chamber 303 has an inner bore 301 (e.g., a fluid passage or conduit) that allows the production fluid to flow through the fluid chamber 303 and into the pump 108.

For example, the fluid chamber 303 is an annular fluid chamber 303 that defines an annular volume "V" that houses the treatment fluid "T." The annular chamber 303 defines an inner bore 301 surrounded by the annular volume "V." The inner bore 301 is fluidly coupled with the inlet 312 (e.g., pump intake) of the pump 108. The inner bore 301 is fluidly decoupled from (e.g., fluidly isolated from) the annular volume "V" and is arranged to direct the production fluid "F" uphole from the wellbore into the pump 108.

Moreover, the fluid chamber 303 includes a scaling elastomer 321 disposed at an external surface 323 of the fluid chamber 303. The sealing elastomer 321 interfaces with a packer 320 to provide, together with the packer 320, a fluid seal. For example, when the packer 320 is set, the elastomer 321 and packer 320 together isolate an annulus uphole of the packer from a zone of the wellbore downhole of the packer 320. In some aspects, the sealing elastomer 321 resides at a downhole end of the fluid chamber 303. The scaling elastomer 321 can be, for example, a flexible ring such as a rubber ring. The sealing elastomer 321 makes a good seal with the internal profile of the packer 320. In some aspects, a similar sealing elastomer can be incorporated into fluid chamber 203 shown in FIG. 2 (which can be used in the tubing deployed systems) for use in suitable applications, such as in tubing deployed inverted ESP systems.

The fluid chamber 303 includes a spring 314 similar to the spring of the fluid chamber 203, with the main exception being that the spring 314 is disposed around the inner bore 301. Moreover, the piston 316 of the fluid chamber 303 is ring-shaped and has seal rings 334, 336 at the inner and outer diameters of the piston 316. The fluid chamber 303 also includes seal rings 334, 335, 336, 338, and 339 that prevent fluid from leaking through the fluid chamber 303.

The packer 320 can be set mechanically, hydraulically, or electrically. For example, the packer 320 can be set via a wireline, eline, or electrically. In some aspects, the packer is set before installing the ESP. For example, after the packer is set, the ESP and fluid chamber are lowered together into the well and "sting" into the packer bore. In some aspects, the fluid chamber 303 can be set or isolated on the production tubing 330 by the chemical chamber packer 320, whereas the production tubing can be set or isolated on the casing 340 of the wellbore by a second packer 350.

Using the fluid chamber with a rigless systems can allow the quick retrieval of ESP and chemical chamber to surface to perform any unscheduled pump maintenance in the field. In some aspects, the rigless system is not through-tubing deployed, and can also be directly installed in a casing.

Figure 4:
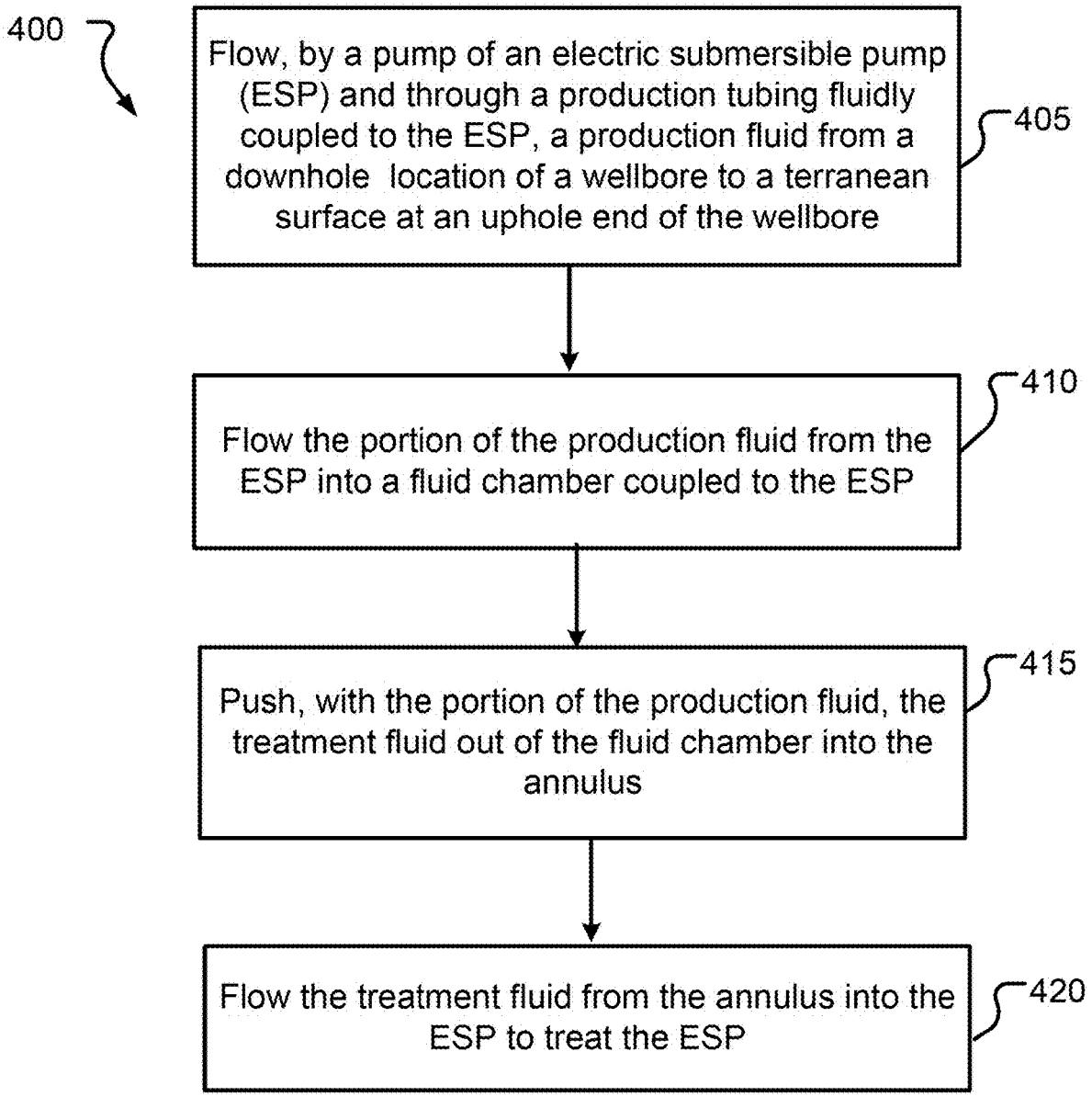
FIG. 4 shows a flow chart of an example method of treating an electrical submersible pump.

FIG. 4 shows a flow chart of an example method (400) of treating an electrical submersible pump (ESP), such as the ESP shown in FIG. 1. The method (400) includes flowing, by a pump of an electric submersible pump (ESP) and through a production tubing fluidly coupled to the ESP, a production fluid from a downhole location of a wellbore to a terranean surface at an uphole end of the wellbore (405). The method also includes flowing the portion of the production fluid from the ESP into a fluid chamber coupled to the ESP (410). The method also includes pushing, with the portion of the production fluid, the treatment fluid out of the fluid chamber into the annulus (415). The method also includes flowing the treatment fluid from the annulus into the ESP to treat the ESP (420).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

Examples

In an example implementation, a method comprises flowing, by a pump of an electric submersible pump (ESP) and through a production tubing fluidly coupled to the ESP, a production fluid from a downhole location of a wellbore to a terranean surface at an uphole end of the wellbore. The method also comprises flowing a portion of the production fluid from the ESP into a fluid chamber coupled to the ESP, the fluid chamber housing a treatment fluid and defining, with a wall of the wellbore, an annulus. The method also comprises pushing, with the portion of the production fluid, the treatment fluid out of the fluid chamber into the annulus. The method also comprises flowing the treatment fluid from the annulus into the ESP to treat the ESP.

In an example implementation combinable with any other example implementation, the pump comprises a production fluid inlet and a production fluid outlet and the fluid chamber comprises a first fluid inlet, a second fluid inlet, and a treatment fluid outlet, a fluid conduit extending from the production fluid outlet of the pump to the first fluid inlet of the fluid chamber, the second fluid inlet arranged to receive the treatment fluid to be stored in the fluid chamber, and the treatment fluid outlet arranged to direct the treatment fluid out of the fluid chamber; and wherein flowing the portion of the production fluid into the fluid chamber comprises flowing the portion of the production fluid from the production fluid outlet of the pump to the first fluid inlet through the fluid conduit.

In an example implementation combinable with any other example implementation, the first fluid inlet resides at a first sub-chamber of the fluid chamber, the first sub-chamber separated from a second sub-chamber of the fluid chamber by a plunger disposed between the first sub-chamber and the second sub-chamber, the second sub-chamber containing the treatment fluid, and wherein flowing the portion of the production fluid into the fluid chamber comprises flowing the portion of the production fluid into the first sub-chamber to push the plunger, thereby pushing the treatment fluid out of the fluid chamber through the treatment fluid outlet.

In an example implementation combinable with any other example implementation, the fluid chamber comprises a tension spring configured to retract the plunger in an uphole direction, the method further comprising reducing a flow of the portion of the production fluid into the fluid chamber, thereby allowing the plunger to be retracted by the tension spring.

In an example implementation combinable with any other example implementation, treating the ESP comprises minimizing a formation of at least one of scale, wax, or asphaltene on the ESP.

In another example implementation, a wellbore assembly comprises a production string, electric submersible pump (ESP), a fluid chamber, and a fluid conduit. The production string is disposed within a wellbore. The electric submersible pump (ESP) lifts production fluid through the production string. The ESP includes a pump and a motor. The pump is fluidly coupled with the production string. The motor is coupled with and configured to drive the pump. The fluid chamber is coupled with the ESP and configured to house a treatment fluid, the fluid chamber defining, together with a wall of the wellbore and with the fluid chamber being coupled with the ESP, an annulus. The fluid conduit fluidly connecting the pump with the fluid chamber to allow the pump to flow a portion of the production fluid into the fluid chamber to push, with the portion of the production fluid, the treatment fluid out of the fluid chamber to the annulus, thereby allowing the treatment fluid to flow from the annulus into the ESP to treat the ESP.

In an example implementation combinable with any other example implementation, the pump comprises a production fluid inlet and a production fluid outlet and the fluid chamber comprises a first fluid inlet, a second fluid inlet, and a treatment fluid outlet, the fluid conduit extending from the production fluid outlet of the pump to the first fluid inlet of the fluid chamber, the second fluid inlet arranged to receive the treatment fluid to be stored in the fluid chamber, and the treatment fluid outlet arranged to direct the treatment fluid out of the fluid chamber.

In an example implementation combinable with any other example implementation, the first fluid inlet resides at a first sub-chamber of the fluid chamber, the first sub-chamber separated from a second sub-chamber of the fluid chamber by a plunger disposed between the first sub-chamber and the second sub-chamber, the second sub-chamber containing the treatment fluid and the first sub-chamber configured to receive the portion of the production fluid that pushes the plunger to push the treatment fluid out of the fluid chamber.

In another example implementation, a chemical injection system comprises an electric submersible pump (ESP) configured to lift a production fluid through a production string disposed within a wellbore; and a fluid chamber coupled with the ESP and configured to house a treatment fluid, the fluid chamber defining, together with a wall of the wellbore, an annulus. The ESP is configured to flow at least a portion of the production fluid into the fluid chamber to push the treatment fluid out of the fluid chamber into the annulus, thereby allowing the treatment fluid to flow from the annulus into the ESP to treat the ESP.

In an example implementation combinable with any other example implementation, the fluid chamber is disposed downhole of the ESP.

In an example implementation combinable with any other example implementation, the chemical injection system further includes a fluid conduit extending between and fluidly coupling the ESP and the fluid chamber, the ESP comprising a pump and a motor configured to drive the pump, and wherein the fluid conduit directs fluid from the pump to the fluid chamber.

In an example implementation combinable with any other example implementation, the motor is disposed between the pump and the fluid chamber.

In an example implementation combinable with any other example implementation, the motor is disposed uphole of the pump and the fluid chamber is coupled directly with the pump, the fluid chamber comprising an annular fluid chamber defining an annular volume configured to house the treatment fluid, the annular fluid chamber defining an inner bore fluidly decoupled from the annular volume and arranged to direct the production fluid uphole from the wellbore into the pump.

In an example implementation combinable with any other example implementation, the pump comprises a production fluid inlet and a production fluid outlet and the fluid chamber comprises a first fluid inlet, a second fluid inlet, and a treatment fluid outlet, the fluid conduit extending from the production fluid outlet of the pump to the first fluid inlet of the fluid chamber, the second fluid inlet arranged to receive the treatment fluid to be stored in the fluid chamber, and the treatment fluid outlet arranged to direct the treatment fluid out of the fluid chamber.

In an example implementation combinable with any other example implementation, the production fluid outlet comprises a discharge head of the pump and the first fluid inlet resides at a first sub-chamber of the fluid chamber, the first sub-chamber separated from a second sub-chamber of the fluid chamber by a plunger disposed between the first sub-chamber and the second sub-chamber, the second sub-chamber containing the treatment fluid and the first sub-chamber configured to receive the at least a portion of the production fluid that pushes the plunger to push the treatment fluid out of the fluid chamber.

In an example implementation combinable with any other example implementation, the fluid chamber comprises a tension spring configured to retract the plunger in an uphole direction.

In an example implementation combinable with any other example implementation, the fluid chamber defines an inner volume arranged to contain the treatment fluid, the treatment fluid comprising a chemical configured to treat the ESP to prevent formation of at least one of scale, wax, or asphaltene on the ESP.

In an example implementation combinable with any other example implementation, the fluid chamber comprises a sealing elastomer disposed at an external surface of the fluid chamber, the sealing elastomer arranged to interface with a packer to provide, together with the packer and with the packer set on the wellbore, a fluid seal.

In an example implementation combinable with any other example implementation, the fluid chamber comprises a valve coupled with a fluid outlet of the fluid chamber, the valve configured to allow the treatment fluid to exit the fluid chamber and prevent fluid from entering the fluid chamber through the fluid outlet.

In an example implementation combinable with any other example implementation, the valve comprises at least one of a check valve or a one-way valve, the valve arranged to open under a first fluid pressure inside the fluid chamber and close under a second fluid pressure inside the fluid chamber, the first fluid pressure being greater than the second fluid pressure.

What is claimed is:

1. A method, comprising:

flowing, by a pump of an electric submersible pump (ESP) and through a production tubing fluidly coupled to the ESP, a production fluid from a downhole location of a wellbore to a terranean surface at an uphole end of the wellbore;

flowing a portion of the production fluid from the ESP into a fluid chamber coupled to the ESP, the fluid chamber housing a treatment fluid and defining, with a wall of the wellbore, an annulus;

pushing, with the portion of the production fluid, the treatment fluid out of the fluid chamber into the annulus; and flowing the treatment fluid from the annulus into the ESP to treat the ESP;

wherein the pump comprises a production fluid inlet and a production fluid outlet and the fluid chamber comprises a first fluid inlet, a second fluid inlet, and a treatment fluid outlet, a fluid conduit extending from the production fluid outlet of the pump to the first fluid inlet of the fluid chamber, the second fluid inlet arranged to receive the treatment fluid to be stored in the fluid chamber, and the treatment fluid outlet arranged to direct the treatment fluid out of the fluid chamber; and wherein flowing the portion of the production fluid into the fluid chamber comprises flowing the portion of the production fluid from the production fluid outlet of the pump to the first fluid inlet through the fluid conduit; and wherein the first fluid inlet resides at a first sub-chamber of the fluid chamber, the first sub-chamber separated from a second sub-chamber of the fluid chamber by a plunger disposed between the first sub-chamber and the second sub-chamber, the second sub-chamber containing the treatment fluid, and wherein flowing the portion of the production fluid into the fluid chamber comprises flowing the portion of the production fluid into the first sub-chamber to push the plunger, thereby pushing the treatment fluid out of the fluid chamber through the treatment fluid outlet.

2. The method of claim 1, wherein the fluid chamber comprises a tension spring configured to retract the plunger in an uphole direction, the method further comprising reducing a flow of the portion of the production fluid into the fluid chamber, thereby allowing the plunger to be retracted by the tension spring.

3. The method of claim 1, wherein treating the ESP comprises minimizing a formation of at least one of scale, wax, or asphaltene on the ESP.

4. A wellbore assembly, comprising:

a production string disposed within a wellbore;

an electric submersible pump (ESP) configured to lift production fluid through the production string, the ESP comprising:

a pump fluidly coupled with the production string, and a motor coupled with and configured to drive the pump;

a fluid chamber coupled with the ESP and configured to house a treatment fluid, the fluid chamber defining, together with a wall of the wellbore and with the fluid chamber being coupled with the ESP, an annulus; and a fluid conduit fluidly connecting the pump with the fluid chamber to allow the pump to flow a portion of the production fluid into the fluid chamber to push, with the portion of the production fluid, the treatment fluid out of the fluid chamber to the annulus, thereby allowing the treatment fluid to flow from the annulus into the ESP to treat the ESP;

wherein the pump comprises a production fluid inlet and a production fluid outlet and the fluid chamber comprises a first fluid inlet, a second fluid inlet, and a treatment fluid outlet, the fluid conduit extending from the production fluid outlet of the pump to the first fluid inlet of the fluid chamber, the second fluid inlet arranged to receive the treatment fluid to be stored in the fluid chamber, and the treatment fluid outlet arranged to direct the treatment fluid out of the fluid chamber; and wherein the first fluid inlet resides at a first sub-chamber of the fluid chamber, the first sub-chamber separated from a second sub-chamber of the fluid chamber by a plunger disposed between the first sub-chamber and the second sub-chamber, the second sub-chamber containing the treatment fluid and the first sub-chamber configured to receive the portion of the production fluid that pushes the plunger to push the treatment fluid out of the fluid chamber.

5. A chemical injection system, comprising:

an electric submersible pump (ESP) configured to lift a production fluid through a production string disposed within a wellbore; and a fluid chamber coupled with the ESP and configured to house a treatment fluid, the fluid chamber defining, together with a wall of the wellbore, an annulus;

wherein the ESP is configured to flow at least a portion of the production fluid into the fluid chamber to push the treatment fluid out of the fluid chamber into the annulus, thereby allowing the treatment fluid to flow from the annulus into the ESP to treat the ESP;

wherein the fluid chamber is disposed downhole of the ESP;

wherein the system further comprises a fluid conduit extending between and fluidly coupling the ESP and the fluid chamber, the ESP comprising a pump and a motor configured to drive the pump, and wherein the fluid conduit directs fluid from the pump to the fluid chamber;

wherein the pump comprises a production fluid inlet and a production fluid outlet and the fluid chamber comprises a first fluid inlet, a second fluid inlet, and a treatment fluid outlet, the fluid conduit extending from the production fluid outlet of the pump to the first fluid inlet of the fluid chamber, the second fluid inlet arranged to receive the treatment fluid to be stored in the fluid chamber, and the treatment fluid outlet arranged to direct the treatment fluid out of the fluid chamber; and wherein the production fluid outlet comprises a discharge head of the pump and the first fluid inlet resides at a first sub-chamber of the fluid chamber, the first sub-chamber separated from a second sub-chamber of the fluid chamber by a plunger disposed between the first sub-chamber and the second sub-chamber, the second sub-chamber containing the treatment fluid and the first sub-chamber configured to receive the at least a portion of the production fluid that pushes the plunger to push the treatment fluid out of the fluid chamber.

6. The chemical injection system of claim 5, wherein the motor is disposed between the pump and the fluid chamber.

7. The chemical injection system of claim 5, wherein the motor is disposed uphole of the pump and the fluid chamber is coupled directly with the pump, the fluid chamber comprising an annular fluid chamber defining an annular volume configured to house the treatment fluid, the annular fluid chamber defining an inner bore fluidly decoupled from the annular volume and arranged to direct the production fluid uphole from the wellbore into the pump.

8. The chemical injection system of claim 5, wherein the fluid chamber comprises a tension spring configured to retract the plunger in an uphole direction.

9. The chemical injection system of claim 5, wherein the fluid chamber defines an inner volume arranged to contain the treatment fluid, the treatment fluid comprising a chemical configured to treat the ESP to prevent formation of at least one of scale, wax, or asphaltene on the ESP.

10. The chemical injection system of claim 5, wherein the fluid chamber comprises a sealing elastomer disposed at an external surface of the fluid chamber, the sealing elastomer arranged to interface with a packer to provide, together with the packer and with the packer set on the wellbore, a fluid seal.

11. The chemical injection system of claim 5, wherein the fluid chamber comprises a valve coupled with a fluid outlet of the fluid chamber, the valve configured to allow the treatment fluid to exit the fluid chamber and prevent fluid from entering the fluid chamber through the fluid outlet.

12. The chemical injection system of claim 11, wherein the valve comprises at least one of a check valve or a one-way valve, the valve arranged to open under a first fluid pressure inside the fluid chamber and close under a second fluid pressure inside the fluid chamber, the first fluid pressure being greater than the second fluid pressure.

* * * * *